US007225970B2

(12) United States Patent
Philips

(10) Patent No.: US 7,225,970 B2
(45) Date of Patent: Jun. 5, 2007

(54) SELF-LOCKING CONTAINER AND CONTAINER BLANK

(75) Inventor: Nicholas A. Philips, Sugar Grove, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 11/094,878

(22) Filed: Mar. 30, 2005

(65) Prior Publication Data

US 2006/0219768 A1 Oct. 5, 2006

(51) Int. Cl.
*B65D 5/24* (2006.01)
*B65D 5/468* (2006.01)

(52) U.S. Cl. ..... 229/171; 229/177; 229/179; 229/186

(58) Field of Classification Search ..... 229/171, 229/177, 179, 186, 117.13, 117.16
See application file for complete search history.

(56) References Cited

U.S. PATENT DOCUMENTS 2,151,472 A * 3/1939 Hubbard ..... 229/186
3,627,541 A * 12/1971 Farquhar ..... 229/186
4,391,405 A 7/1983 Drinon
4,648,549 A * 3/1987 Trutna ..... 229/177
5,050,794 A * 9/1991 Wischusen, III ..... 229/179
5,255,841 A * 10/1993 Ritter ..... 229/177
5,284,294 A * 2/1994 Floyd ..... 229/179
5,307,982 A * 5/1994 Swindell ..... 229/186

* cited by examiner

*Primary Examiner*—Gary E. Elkins

(57) ABSTRACT

The embodiments of the present invention provide a blank of foldable material that configured to form a container. When formed, the container is completely self-locking. Additionally, when the blank is formed with any number of known liquid-proof sheet material or coatings, the container provides a leak/sift proof structure. Also, the container provides for all inside surfaces to be smooth, flat and interrupted surfaces. Further, as the hand hold cutouts are covered by end panels, the container retards hot or cold inside temperature degradation, which make the container ideal for use as a low-cost cooler or the like.

4 Claims, 5 Drawing Sheets

SELF-LOCKING CONTAINER AND CONTAINER BLANK

FIELD OF THE INVENTION

This invention relates generally to cellulose based blanks and containers and, more specifically to wood cellulose based blanks and containers.

BRIEF DESCRIPTION OF THE DRAWINGS

Various embodiments of the present invention are described in detail below with reference to the following drawings.

DETAILED DESCRIPTION OF THE INVENTION

The present invention provides a blank and resulting container for holding any variety of goods. By way of overview and with references to FIGS. 1 through 8, an embodiment of the present invention includes a single piece blank 20 of foldable material arranged to form a container 60. Specific details of the blank 20 and container 60 are described with more particularity below.

Figure 1:
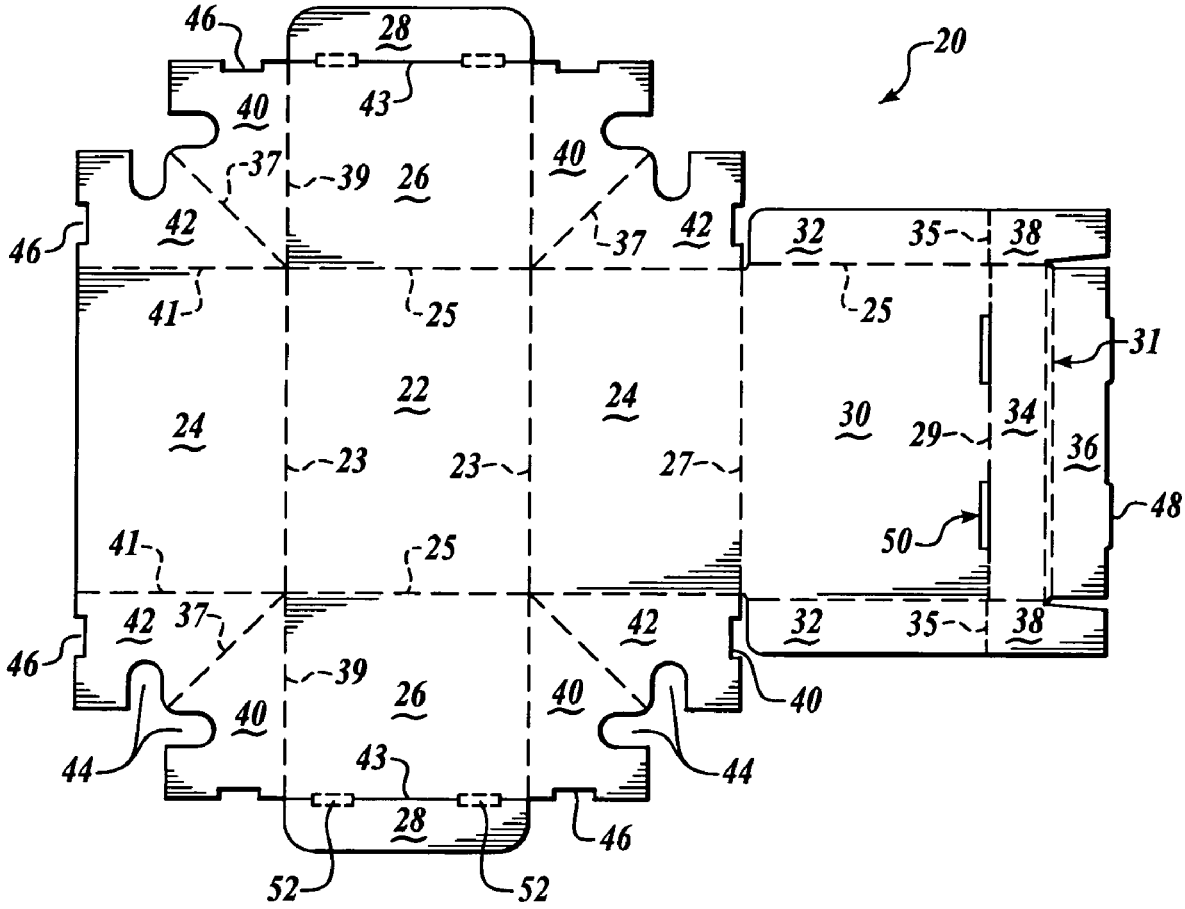
FIG. 1 is plan view of a single piece container blank formed in accordance with an aspect of the present invention.

FIG. 1 depicts the blank 20 used to form the container 60. The blank 20 is preferably constructed from a single piece of formable material such as, without limitation, sheets of cellulose based materials formed from cellulose materials such as wood pulp, straw, cotton, bagasse and the like. Cellulose based materials useful in the present invention come in many forms such as fibreboard, containerboard, corrugated containerboard and paperboard. The blank 20 is cut, scored, perforated or otherwise formed to include a plurality of panels that when assembled form container 60. In all FIGURES, like numbers indicate like parts. Additionally, cut lines are shown as solid lines, scored lines as dashed lines, and lines of perforations as broken lines.

The blank 20 includes a bottom panel 22. The bottom panel 22 is substantially rectangular in shape. The bottom panel 22 is connected with opposed side panels 24 along fold lines 23. Additionally, bottom panel 22 includes or is connected with opposed end panels 26 along fold lines 25.

The side panels 24 are generally rectangular in shape. Side panels 24 also include side panel corner flaps 42 that are attached to the side panels 24 along fold lines 41. Side panel corner flaps 42 are generally triangular in shape and are connected to an end panel corner flap 40 along a fold line 37, opposite fold line 41. The side panel corner flap 42 also includes a hand-hold cut-out 44. Additionally, side panel corner flap 42 includes a bridge section cut-out 46 on its outer periphery.

The end panel corner flap 40 is generally triangular in shape and, as discussed above, is connected with the side panel corner flap 42 along fold line 37. The end panel corner flap 40 is also connected with end panel 26 along a fold line 39 opposite fold line 37. The end panel corner flap also includes a hand-hold cut-out 44 and a bridge section cut-out 46 on its outer periphery. As depicted in the FIGURES, the hand-hold cut-out 44 and a bridge section cut-out 46 on the side panel corner flap 42 are symmetric about fold line 37 with respect to the hand-hold cut-out 44 and a bridge section cut-out 46 on the end panel corner flap 40.

End panels 26 are generally rectangular or square in shape. End panel 26 includes an end panel flap 28 opposite the bottom panel 22. End panel 28 is connected with the end panel 26 via bridge sections 52 that extend across cut line 43.

A top panel 30 is coupled with or attached with one of the side panels 24 along a fold line 27. The top panel 30 is generally rectangular in shape and includes opposed top panel side flaps 32 that are connected to the top panel 30 along a fold line 33. The top panel 30 also includes a top panel outer flap 34 connected to the top panel 30 along a fold line 29 and a top panel inner flap 36 which is connected to the top panel outer flap 34 along spaced apart fold lines 31. The top panel 30 also includes slots 50 that are positioned to interact with locking tabs 48 positioned on an outer periphery of the top panel inner flap 36.

The top panel side flaps 32 each include a top panel side flap tab 38. The top panel side flap tab 38 is connected with the top panel side flap 32 along a fold line 35. The top panel side flap tab 38 is not connected directly to either the top panel outer flap 34 or the top panel inner flap 36.

In order to further illustrate the various aspects of the embodiments of the invention, FIGS. 2–8 depict the blank 20 being erected into the container 60.

For the purposes of further description herein, the downward direction is defined as the direction perpendicular to the bottom panel 22 that corresponds to outer surface of the bottom panel when the container 60 has been erected. The upward direction is defined as the direction perpendicular to the bottom panel 22 that corresponds to the inner surface of the bottom panel when the container 60 has been erected.

Figure 2:
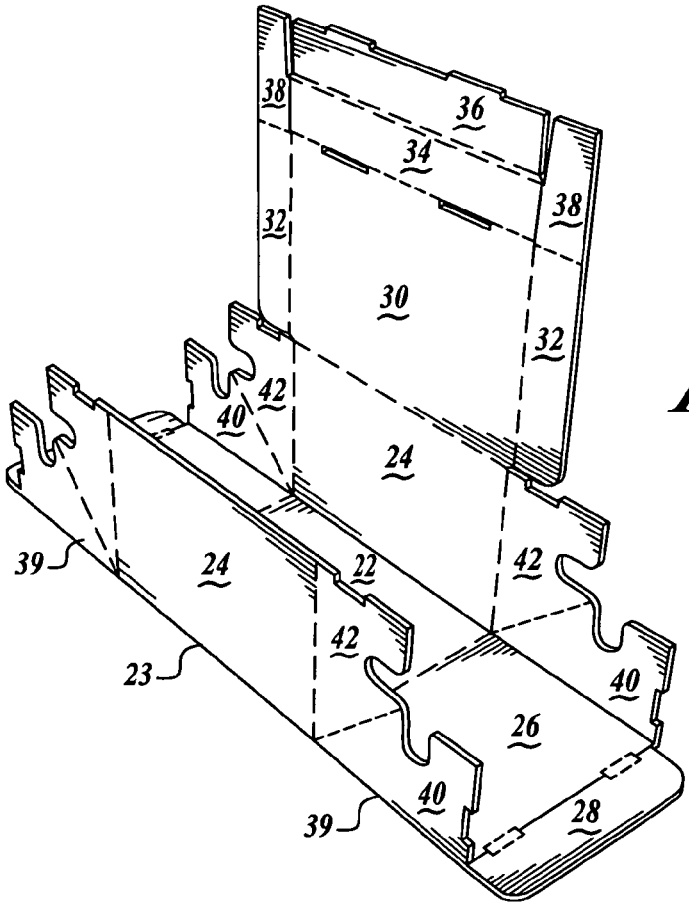
FIG. 2 is a perspective view of a partially assembled container assembly according to an aspect of the present invention.
Figure 3:
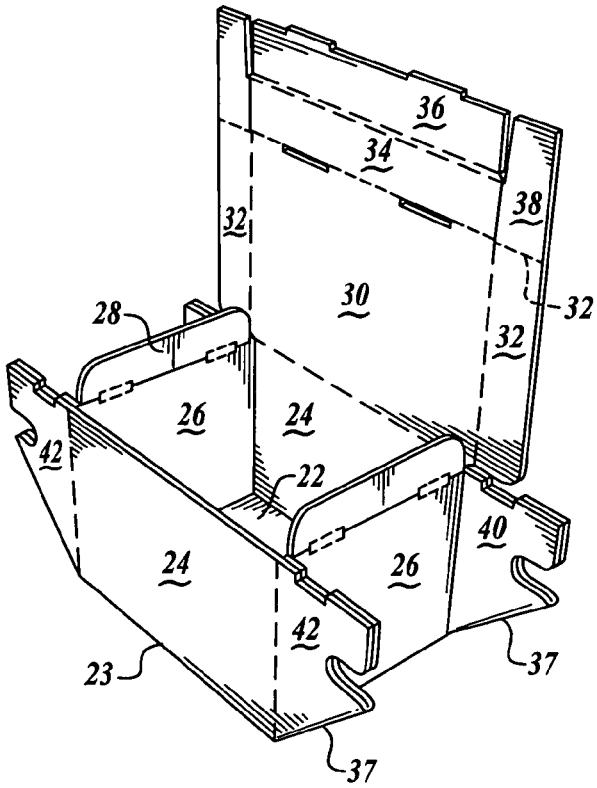
FIG. 3 is another perspective view of a partially assembled container assembly according to an aspect of the present invention.

With reference to FIGS. 2 and 3, the first step in forming the container is to fold the side panels 24 and the end panel corner flap 40 inwardly approximately 90 degrees along fold lines 23 and 39 respectively. Subsequently the end panels 26 may be folded upwardly along fold line 25. The folding of the end panels 26 and side panels 24 to form the general outline of the container, and brings the end panel corner flap 40 and side panel corner flap 42 into juxtaposition as best shown in FIG. 3.

Figure 4:
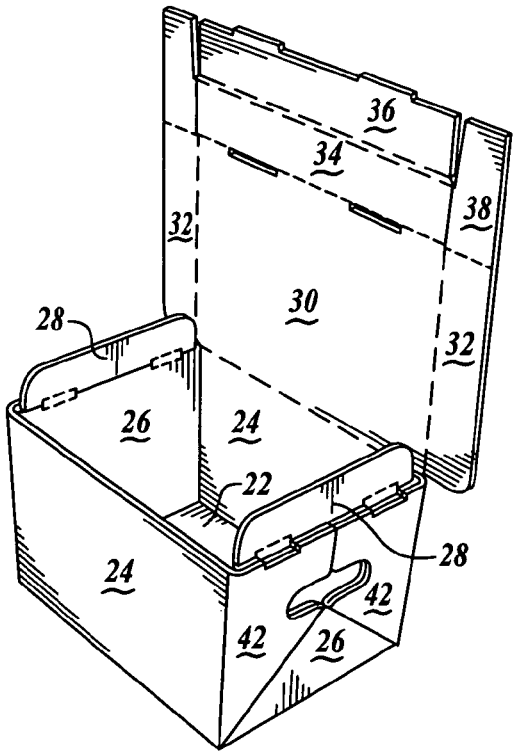
FIG. 4 is another perspective view of a partially assembled container assembly according to an aspect of the present invention.
Figure 5:
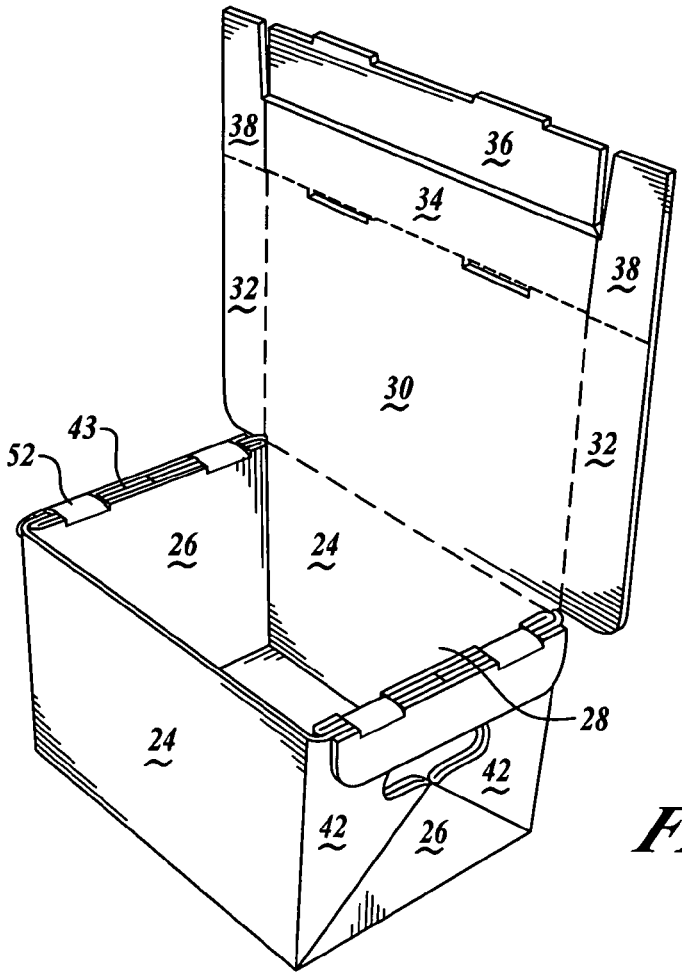
FIG. 5 is another perspective view of a partially assembled container assembly according to an aspect of the present invention.
Figure 6:
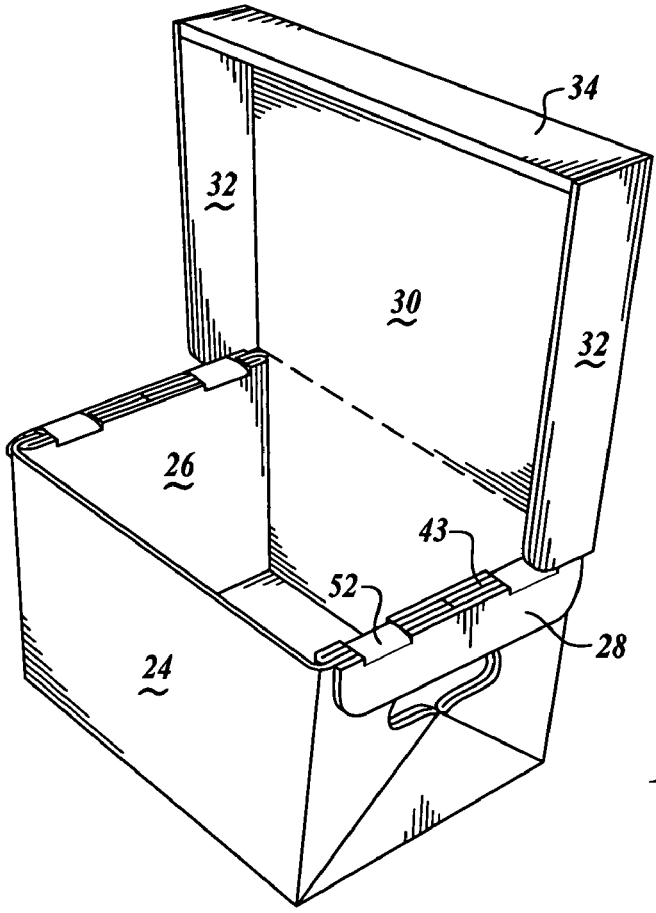
FIG. 6 is yet another perspective view of a partially assembled container assembly according to an aspect of the present invention.

With specific reference to FIGS. 4–6, the next step in the formation of the container is to fold the juxtaposed end panel corner flaps 40 and side panel corner flaps 42 inwardly with respect to now adjacent fold lines 41 and 39. As best seen in FIG. 5, the end panel flap 28 may then be folded down outwardly and downwardly over the end panel corner flap 40 and the side panel corner flap 42 and end panel 26. In folding the end panel flap 28 outwardly and downwardly, the bridge section 52 correspondingly engages the bridge section cut-out 46, thereby relatively securely holding the various side panels 24, end panels 26, end panel corner flaps 40, and side panel corner flaps 42 in a locked position.

Figure 7:
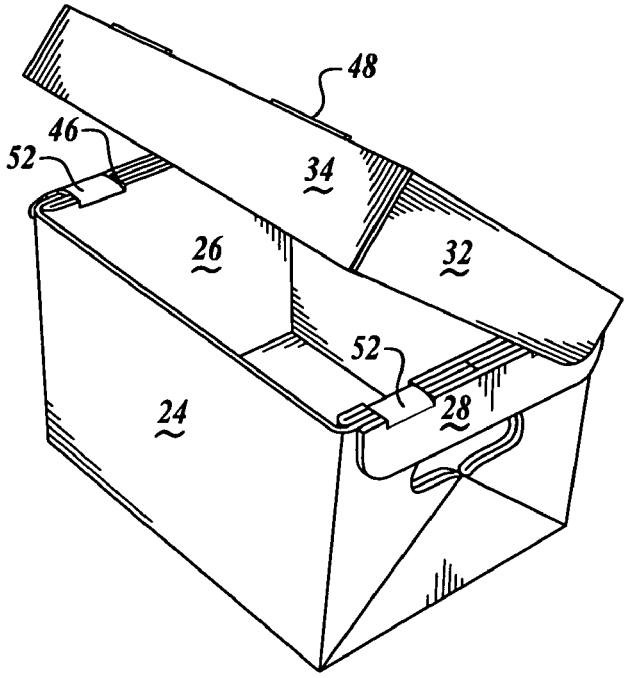
FIG. 7 is still another perspective view of a partially assembled container assembly according to an aspect of the present invention; and, FIG. 8 is a perspective view of the assembled container according to an aspect of the present invention.
Figure 8:
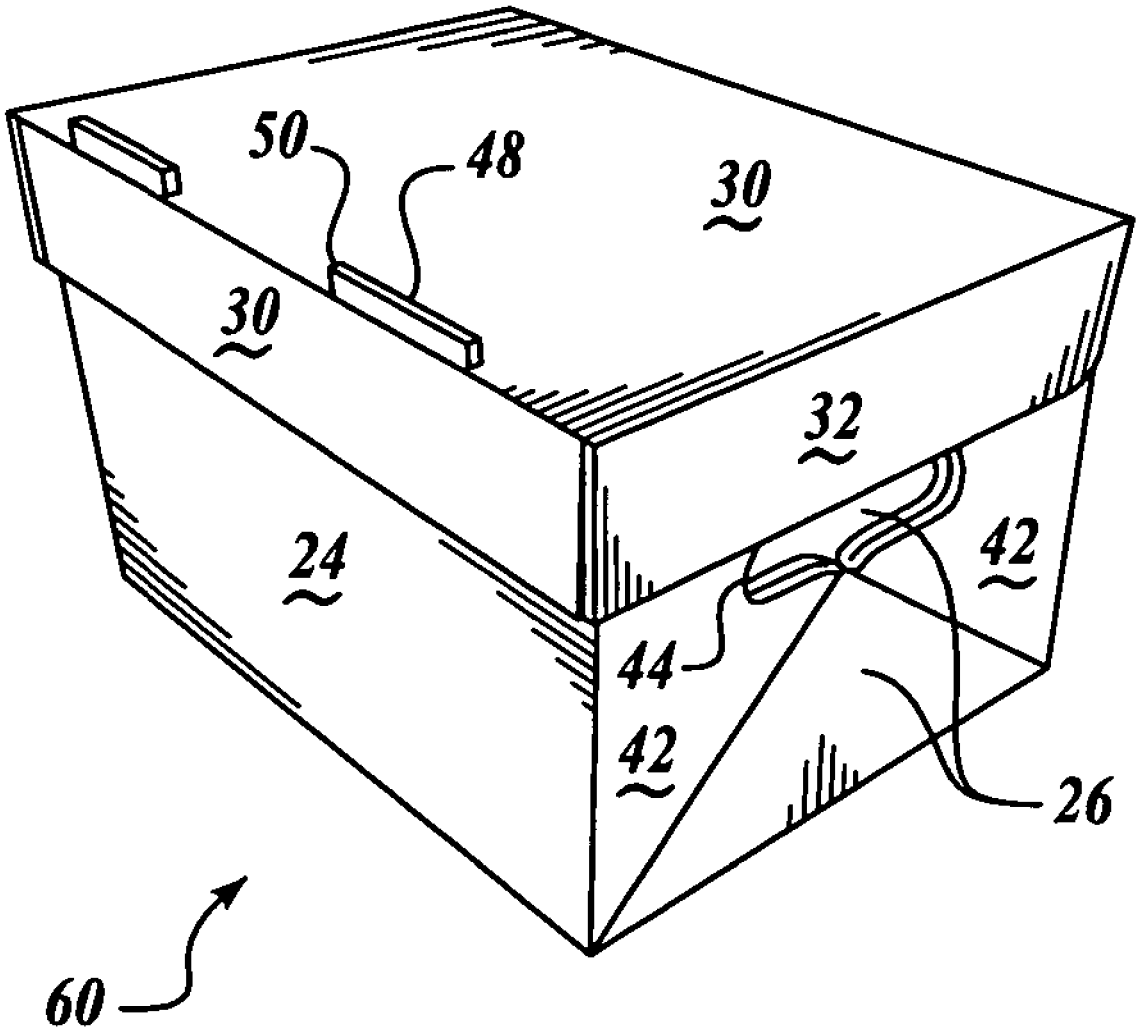

The top panel assembly may be formed by folding top panel side flaps 32 inwardly approximately 90 degrees along fold line 33. Subsequently, top panel side flap tab 38 may be folded approximately 90 degrees inwardly along fold line 35. The top panel inner flap 36 may then be folded to encompass the top panel side flap tab 38 in between the now juxtaposed top panel inner flap 36 and top panel outer flap 34. The locking tabs 48 may then be inserted into the slots 50, thereby relatively securing the top panel assembly. As best seen in FIGS. 7 and 8, the container can be completed by folding the top panel 30 downwardly along fold line 27 to close the container.

It will be appreciated by those skilled in the art that the embodiments provide an easily formed and easily assembled container from a single piece of foldable material. The container includes a variety of side and end panels that can be locked into position relatively quickly and easily. The container 60 also includes a foldable top that not only provides additional structural support, but provides a cover for the container 60. As best seen in FIGS. 7 and 8, the hand-hold cut-outs 44 do not pass through to the inside of the container, as the end panel 26 seals that hole off. This allows the container to still provide a hand-hold for the container while preventing any entrance or loss of contents of the container through the hand-hold cut-outs. In this manner, the container can be used as a disposable cooler, whereby ice and cold products may be stored inside and they will maintain their temperature.

It will be appreciated by those skilled in the art that the blank 20 and container 60 embodiments disclosed herein contain many advantages. When formed, the container 60 is completely self-locking, thus, although they may be use, adhesive or mechanical fasteners are unnecessary to assemble and use the container 60. Additionally, when the blank 30 is formed with any number of known liquid-proof sheet material or coatings, the container 60 provides a leak or sift proof structure. Further, as the hand hold cutouts 44 are covered by end panels 26, the container 60 retards hot or cold inside temperature degradation, which make the container 60 ideal for use as a disposable cooler or the like.

While the various embodiments of the invention has been illustrated and described, as noted above, many changes can be made without departing from the spirit and scope of the invention. Accordingly, the scope of the invention is not limited by the disclosure of the various embodiments. Instead, the invention should be determined entirely by reference to the claims that follow.

What is claimed is:

1. A single sheet of foldable material cut and scored to define a container, comprising:

a bottom panel;

an end panel connected with the bottom panel, said end panel having an outer surface;

a side panel connected with the bottom panel;

an end panel corner flap connected with said end panel, said end panel corner flap being adjacent the outer surface;

a side panel corner flap connected with said side panel, said side panel corner flap also being connected with said end panel corner flap along a fold line, said side panel corner flap and said end panel corner flap being substantially symmetric about the fold line there between;

a handhold cutout formed in an outer edge of said end panel corner flap and said side panel corner flap, said handhold cutout extending through both said end panel corner flap and said side panel corner flap but not said end panel; and a bridge section cutout formed in a top edge of said end panel corner flap and said side panel corner flap.

2. The container of claim 1, wherein the single sheet of foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

* * * * *